US008824915B2

(12) United States Patent
Makino

(10) Patent No.: US 8,824,915 B2
(45) Date of Patent: Sep. 2, 2014

(54) IMAGE FORMING APPARATUS WITH FAN CONTROL

(75) Inventor: Yuichi Makino, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 368 days.

(21) Appl. No.: 13/042,811

(22) Filed: Mar. 8, 2011

(65) Prior Publication Data

US 2011/0222897 A1 Sep. 15, 2011

(30) Foreign Application Priority Data

Mar. 9, 2010 (JP) ..... 2010-052020

(51) Int. Cl.
*G03G 21/20* (2006.01)
*G03G 21/00* (2006.01)
*G03G 15/02* (2006.01)

(52) U.S. Cl.
USPC ..... 399/92; 399/98; 399/100

(58) Field of Classification Search
USPC ..... 399/92, 98, 100
See application file for complete search history.

(56) References Cited

U.S. PATENT DOCUMENTS

| | | | | | |
|---|---|---|---|---|---|
| 4,607,936 | A * | 8/1986 | Miyakawa et al. | 399/92 |
| 4,745,282 | A * | 5/1988 | Tagawa et al. | 250/326 |
| 5,081,496 | A * | 1/1992 | Takeda | 399/92 |
| 5,291,247 | A * | 3/1994 | DeCecca | 399/92 |
| 5,504,560 | A * | 4/1996 | Kitagaki et al. | 399/168 |
| 5,612,768 | A * | 3/1997 | Kim et al. | 399/92 |
| 7,599,642 | B2 | 10/2009 | Nakajima et al. | |
| 7,616,912 | B2 * | 11/2009 | Nishimura et al. | 399/92 |
| 2003/0219274 | A1 * | 11/2003 | Hirose et al. | 399/92 |
| 2005/0074254 | A1 * | 4/2005 | Maeda | 399/92 |
| 2005/0238379 | A1 * | 10/2005 | Ogane et al. | 399/92 |
| 2006/0024082 | A1 * | 2/2006 | Gila et al. | 399/93 |
| 2007/0036577 | A1 * | 2/2007 | Okabe et al. | 399/92 |
| 2008/0038011 | A1 | 2/2008 | Nakajima et al. | |
| 2008/0317494 | A1 * | 12/2008 | Budding et al. | 399/100 |
| 2009/0016762 | A1 * | 1/2009 | Ota | 399/74 |
| 2009/0136253 | A1 | 5/2009 | Nakajima et al. | |
| 2011/0222898 | A1 * | 9/2011 | Kidaka | 399/97 |
| 2011/0222899 | A1 * | 9/2011 | Kidaka | 399/98 |
| 2011/0222900 | A1 * | 9/2011 | Makino | 399/98 |
| 2011/0222901 | A1 * | 9/2011 | Makino | 399/98 |

FOREIGN PATENT DOCUMENTS

| | | | | |
|---|---|---|---|---|
| JP | 04093864 | A * | 3/1992 | G03G 15/02 |
| JP | 2003076118 | A * | 3/2003 | G03G 15/02 |
| JP | 2007072212 | A * | 3/2007 | |
| JP | 2008-46297 | A | 2/2008 | |

* cited by examiner

*Primary Examiner* — David Bolduc
(74) *Attorney, Agent, or Firm* — Fitzpatrick, Cella, Harper & Scinto

(57) ABSTRACT

An image forming apparatus includes a corona charger, including a charging electrode, for charging a photosensitive member; a cleaning member for cleaning the charging electrode; a shutter in the form of a sheet for opening and closing an opening provided between the charging electrode of the corona charger and the photosensitive member; a driving unit for driving the shutter and the cleaning member; a fan for supplying the air toward the photosensitive member through the opening of the corona charger; and a controller for controlling the fan such that an air supply operation of the fan is stopped before the shutter operates to close the opening.

13 Claims, 9 Drawing Sheets

IMAGE FORMING APPARATUS WITH FAN CONTROL

FIELD OF THE INVENTION AND RELATED ART

The present invention relates to an image forming apparatus such as a copying machine, a printer, a facsimile machine, etc.

An electrophotographic image forming apparatus forms an image through an electrophotographic sequence which comprises a charging process, an exposing process, a developing process, and a transferring process. It has been known that in the charging process, a photosensitive member is charged to a preset potential level with the use of a charging device which utilizes electrical discharge (corona).

The charging process which uses a charging device of the corona type (which hereafter will be referred to as corona charger) uses the corona which results from electrical discharge. Thus, it produces ozone ($O_3$), and oxides of nitrogen (NOx), which are the byproducts of electrical discharge. If these byproducts of electrical discharge adhere to a photosensitive member and absorb humidity, the photosensitive member reduces in surface resistance across the areas covered with the byproducts, which is one of the primary causes of the so-called "image deletion" phenomenon, that is, a phenomenon (problem) that an image forming apparatus fails to form an electrostatic latent image which exactly reflects the information regarding an image to be formed.

One of the known solutions to the abovementioned problem is to provide a corona charger with a shutter to keep the opening of the charging device closed in order to prevent the byproducts of electrical discharge from adhering to a photosensitive drum when the charging device is not in the use for image formation. More concretely, there is the solution proposed in Japanese Laid-open Patent Application 2008-046297. According to this solution, the corona charger is provided with a shutter which is movable in the lengthwise direction of the charging device to expose or block the opening of the charging device.

In addition to the problem described above, the byproducts of electric discharge contaminate a corona charger, causing thereby the charging device to fail to properly charge a photosensitive member. More concretely, the adhesion of the byproducts of electrical discharge to the charge wire(s) of a charging device makes the charging device abnormal in electrical discharge, making it thereby impossible for the charging device to uniformly charge a photosensitive member. One of the known solutions to this problem is to provide a corona charger with a cleaning member for cleaning the electrodes of the charging device, and also, a fan for expelling the byproducts of electrical discharge which are lingering (floating) in the air in the internal space of the charging device.

In other words, in order to prevent the occurrence of "image deletion" and improper charging of a photosensitive member, it is desired that a corona charger has: a shutter for keeping the opening of the charging device blocked when it is not in use for image formation; a cleaning member for cleaning the electrodes of the charging device; and a fan for exhausting the air in the charging device to expel the byproducts of electrical discharge which are lingering (floating) in the air. A corona charger, such as those described above is structured so that the shutter for blocking the opening of the charging device, and the cleaning member for cleaning the electrodes of the device, are movable in the lengthwise direction of the charging device. Therefore, it is reasonable to think that a charging apparatus of the corona type structured as described can be simplified in structure by designing the apparatus so that the shutter and cleaning member are driven with the same driving means. However, the employment of this structural arrangement created the following problem.

That is, in the case where a corona charger is provided with a cleaning member which is movable to clean the charging electrode(s), a fan for ventilating the charging device, and a shutter for blocking the opening of the charging device, in order to prevent the occurrence of the improper charging of the image bearing member, and the occurrence of "image deletion", as the opening of the charging device is blocked by the shutter to prevent the occurrence of "image deletion", the airflow created by the fan to expel the byproducts of electrical discharge, which are floating in the charging device, out of the device, is disturbed, resulting in the creation of undesirable turbulence. This turbulence causes the byproducts of electrical discharge in the charging device to swirl up and adhere to the charging electrode(s). As long as the charging device is structured so that the shutter and cleaning member are independently movable from each other, the charging electrode(s) has only to be cleaned as necessary. However, in the case where a charging device is structured so that the shutter and cleaning member are driven by the same mechanism, as the cleaning member is moved, the shutter also moves. Thus, as the cleaning member is moved to clean the charging electrode(s), the cleaned charging electrode(s) is contaminated again by the byproducts of electrical discharge which were made to swirl up by the aforementioned turbulence. Consequently, the image bearing member is improperly charged, in spite of the provision of the shutter and cleaning member.

SUMMARY OF THE INVENTION

Thus, the primary object of the present invention is to provide a corona charger, which is structured to drive its member for cleaning its charging electrodes, and its shutter for closing the opening of the charging device, with the same driving means, and yet, does not improperly charge an object to be charged.

According to an aspect of the present invention, there is provided an image forming apparatus comprising a corona charger, including a charging electrode, for charging a photosensitive member; a cleaning member for cleaning said charging electrode; a shutter in the form of a sheet for opening and closing an opening provided between the charging electrode of said corona charger and the photosensitive member; driving means for driving said shutter and said cleaning member; a first fan for supplying the air toward said photosensitive member through the opening of said corona charger; and control means for controlling said fan such that air supply operation of said first fan is stopped before said shutter operates to close the opening.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

Figure 1:
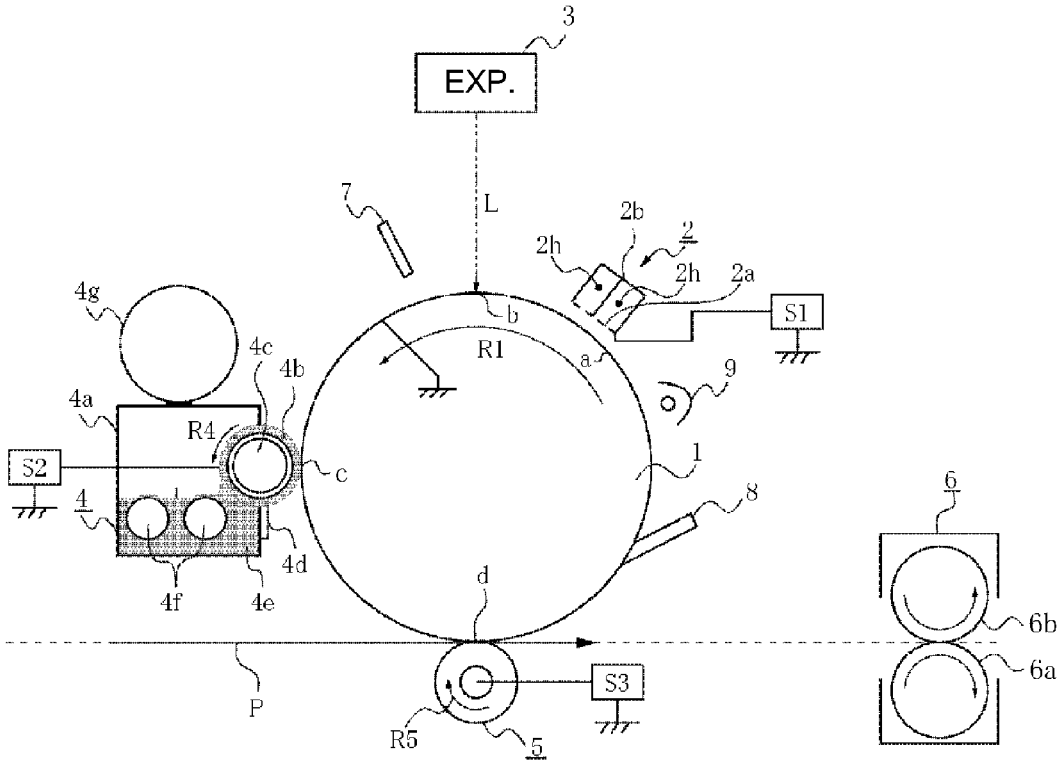
FIG. 1 is a schematic sectional view of the image forming apparatus in the first preferred embodiment of the present invention, and describes the general structure of the apparatus.

First, referring to FIG. 1, the general structure of the image forming apparatus in this embodiment is described. Then, the mechanism for opening, or closing the shutter to keep blocked the opening of the corona charger, is described. Then, the corona charger shutter, and the mechanism and control circuit for opening or closing the corona charger shutter, are described. Lastly, the control of the main assembly of the image forming apparatus is described with reference to a flowchart.

{General Structure of Image Forming Apparatus}

FIG. 1 is a drawing for describing the general structure of the image forming apparatus in the first of the preferred embodiments of the present invention. Referring to FIG. 1, the image forming apparatus has a photosensitive member 1 (image bearing member). It has also a charging apparatus 2, an exposing apparatus 3, a potential level measuring apparatus 7, a developing apparatus 4, a transferring apparatus 5, a cleaning apparatus 8, and a charge removing optical apparatus 9, which are sequentially positioned in the listed order (direction indicated by arrow mark R1) in the adjacencies of the peripheral surface of the photosensitive member 1. Further, the image forming apparatus has a fixing apparatus 6, which is on the downstream side of the transferring apparatus 5 in terms of the direction in which a sheet P of recording medium is conveyed. Next, the image forming devices which are involved in image formation are described in detail in the order of their involvement in image formation.

(Photosensitive Member)

Referring to FIG. 1, the photosensitive member 1, which is the image bearing member in this embodiment, is a cylindrical electrophotographic member (photosensitive drum), and has a photosensitive layer made up of negatively chargeable organic semiconductor. The photosensitive member 1 is 84 mm in diameter, and 380 mm in length. This photosensitive member is rotated about its axis at a process speed (peripheral velocity) of 500 mm/sec in the direction indicated by the arrow mark R1.

(Charging Apparatus)

Next, the charging apparatus 2, which is a corona charger (scorotron) for charging the photosensitive member 1 (object to be charged) is described. Referring to FIG. 1, the charging apparatus 2 in this embodiment is a corona charger (scorotron), has: discharge wires 2*h* as electrodes for electrical discharge; a shield 2*b* which is electrically conductive, U-shaped in cross section, and surrounds the wire 2*h*; and an electrode 2*a*, which is in the form of a grid, and covers the opening of the shield 2*b*. Further, in order to make the image forming apparatus faster in the image formation speed, the charging apparatus 2 in this embodiment has two discharge wires 2*h*. Further, the shied 2 is provided with a partition wall which keeps the two discharge wires 2*h* blocked from each other.

The image forming apparatus is structured so that the lengthwise direction of the corona charger 2 in this embodiment is parallel to the generatrix of the photosensitive member 1. Thus, the lengthwise direction of the corona charger 2 is parallel to the axial line of the photosensitive member 1. Further, the grid electrode 2*a* is shaped and positioned so that the distance between its center portion, in terms of the widthwise direction (moving direction of peripheral surface of photosensitive member 1), and the peripheral surface of the photosensitive member 1 is less than the distance between either of its edges, in terms of the widthwise direction, and the peripheral surface of the photosensitive member 1. Therefore, the corona charger 2 in this embodiment can be placed significantly closer to the peripheral surface of the photosensitive member 1 to improve the charger 2 in the efficiency with which it can charge the photosensitive member 1, than any of the conventional charging devices of the corona type.

Further, the corona charger 2 is in electrical connection to an electric power source S1 for providing the corona charger 2 with the voltage for providing charge bias. That is, the corona charger 2 uniformly charges the peripheral surface of the photosensitive member 1 to a preset negative potential level with the use of the charge bias provided by the electric power source S1. More concretely, the corona charger 2 is structured so that a charge bias, which is a combination of a DC voltage and an AC voltage is applied to the discharge wires 2*h* and grid electrode 2*a*.

Further, the corona charger 2 in this embodiment has a shutter, which is for preventing the byproducts of the electrical discharge for charging the photosensitive member 1 from adhering to the photosensitive member 1. It has also: a cleaning member for cleaning the discharge wires 2*h*, which is moved by the same screw as the screw by which the shutter is moved. Further, the corona charger 2 has a fan, which is a means for blowing air toward the photosensitive member 1 through the opening of the corona charger 2, in order to prevent the byproducts of electrical discharge from becoming stagnant in the corona charger 2. The structures of these components are going to be described later in detail.

(Other Apparatuses Than Image Bearing Member and Exposing Apparatus)

Next, the image forming devices related to the image formation processes, more specifically, the exposing, developing, and transferring processes, etc., are briefly described. The exposing apparatus 3 in this embodiment is a laser beam scanner, which has a semiconductor laser for projecting a beam L of laser light upon the peripheral surface of the photosensitive member 1 right after the peripheral surface is charged by the corona charger 2. More concretely, image formation signals are transmitted to the image forming apparatus from a host computer which is in connection with the image forming apparatus through a network cable. The exposing apparatus 3 outputs the beam L of laser light while modulating the beam L with the image formation signals, in such a manner that the beam L of laser light scans the charged peripheral surface of the photosensitive member 1 in the primary scan direction (direction perpendicular to rotational direction of photosensitive member 1) at an exposing point b (line). As a given point (pixel) of the charged portion of the peripheral surface of the photosensitive member 1 is exposed to the beam L of laser light, it reduces in potential. The exposing apparatus 3 continuously repeats this scanning action in the primary scan direction while the photosensitive member 1 is rotated. Thus, an electrostatic latent image, which reflects the information of an image to be formed, is formed on the peripheral surface of the photosensitive member 1. Incidentally, the "primary scan direction" means the direction parallel to the generatrix of the photosensitive member 1, whereas the "secondary scan direction" means the direction parallel to the rotational direction of the photosensitive member 1.

The charging apparatus 2 and exposing apparatus 3 form an electrostatic latent image on the photosensitive member 1 as described above. Then, the developing apparatus 4 in this embodiment develops the electrostatic latent image into a visible image by adhering developer (toner) to the electrostatic latent image. It uses the so-called "two-component magnetic brush development method", and develops the electrostatic latent image in reverse. The development sleeve 4*b* of the developing apparatus 4 is in connection to an electric power source S2 for providing the developing apparatus 4 with development bias. The two-component developer is borne on the peripheral surface of the development sleeve 4*b*, and the toner in the developer is adhered to the peripheral surface of the photosensitive member 1 in the pattern of the electrostatic latent image on the photosensitive member 1, by the electric field formed by the development bias applied by the electric power source S2. Thus, the electrostatic latent image is developed into an image formed of toner (which hereafter will be referred to simply as toner image). In the case of the developing apparatus 4 in this embodiment, toner is adhered to the exposed portions (portions upon which beam L of laser light was projected) of the peripheral surface of the photosensitive member 1; the electrostatic latent image is developed in reverse.

Referring again to FIG. 1, the transferring apparatus 5 in this embodiment has a transfer roller, which is under a preset amount of pressure, being thereby kept pressed upon the peripheral surface of the photosensitive member 1. Thus, a compression nip is present between the peripheral surface of the photosensitive member 1 and transfer roller. This nip is a transfer portion d, to which a sheet P of recording medium P (paper, transparent film, etc.) is conveyed from a sheet feeder cassette. The sheet P of recording medium is conveyed through the transfer portion d while remaining pinched between the photosensitive member 1 and transfer roller. While the sheet P of recording medium is conveyed through the transfer portion d, transfer bias is applied to the transfer roller from an electric power source S3 for applying transfer bias, whereby the toner image on the photosensitive member 1 is transferred onto the sheet P of recording medium. The transfer bias applied in this embodiment (+2 kV for example) is opposite in polarity to the normal polarity (negative) to which toner becomes charged.

Referring again to FIG. 1, the fixing apparatus 6 in this embodiment has a fixation roller 6*a* and a pressure roller 6*b*. After the toner image is transferred onto the sheet P of recording medium by the transferring apparatus 5, the sheet P is conveyed to the fixing apparatus 6. In the fixing apparatus 6, heat and pressure are applied to the sheet P, and the toner image thereon, by the fixation roller 6*a* and pressure roller 6*b*, whereby the toner image becomes fixed to the sheet P. After the fixation of the toner image to the sheet P, the sheet P is discharged from the main assembly of the image forming apparatus.

Referring to FIG. 1, the cleaning apparatus 8 in this embodiment has a cleaning blade 8. After the transfer of the toner image onto the sheet P of recording medium by the transferring apparatus 6, the transfer residual toner, that is, the toner remaining on the peripheral surface of the photosensitive member 1 after the transfer, is removed by the cleaning blade 8.

Referring to FIG. 1, the charge removing apparatus 9 (optical apparatus) in this embodiment has an exposure lamp for removing electrical charge. After the photosensitive member 1 is cleaned across its peripheral surface by the cleaning apparatus 8, the cleaned portion of the peripheral surface of the photosensitive member 1 is exposed to the light from the lamp of the charge removing apparatus 9, whereby the electric charge remaining on the peripheral surface of the photosensitive member 1 is removed.

After the completion of the image formation sequence carried out by the various image forming devices described above, the image forming apparatus is prepared for the next round of image formation.

(Operational Modes)

The image forming apparatus described above forms images in response to the image formation signals (image formation job signals) inputted into the apparatus (Image Formation Mode). After the completion of each image formation job, the image forming apparatus is placed in the standby mode, in which the temperature of the fixing apparatus is kept at a preset level (standby level) in order to reduce the length of time necessary to start up the fixing apparatus in response to the inputting of the image formation signals for the next job. The preset level (standby level) at which the temperature of the fixing apparatus is kept in the standby mode is lower than the fixation temperature level. After the elapse of a preset length of time (roughly 3 minutes) after the completion of each image formation job, the image forming apparatus is placed in the low electric power consumption mode, which is smaller in the amount of electric power consumption than the standby mode. In the standby mode in this embodiment, the shutter of the charging device is kept open. However, it is to be closed to block the opening of the charging device when the image forming apparatus is changed in operational mode from the standby mode to the low electric power consumption mode. Further, in this embodiment, the charging wires are cleaned for every preset number (1,000, for example) of images formed during an image forming operation (cleaning mode).

{Detailed Description of Charging Apparatus Structure}

Figure 2:
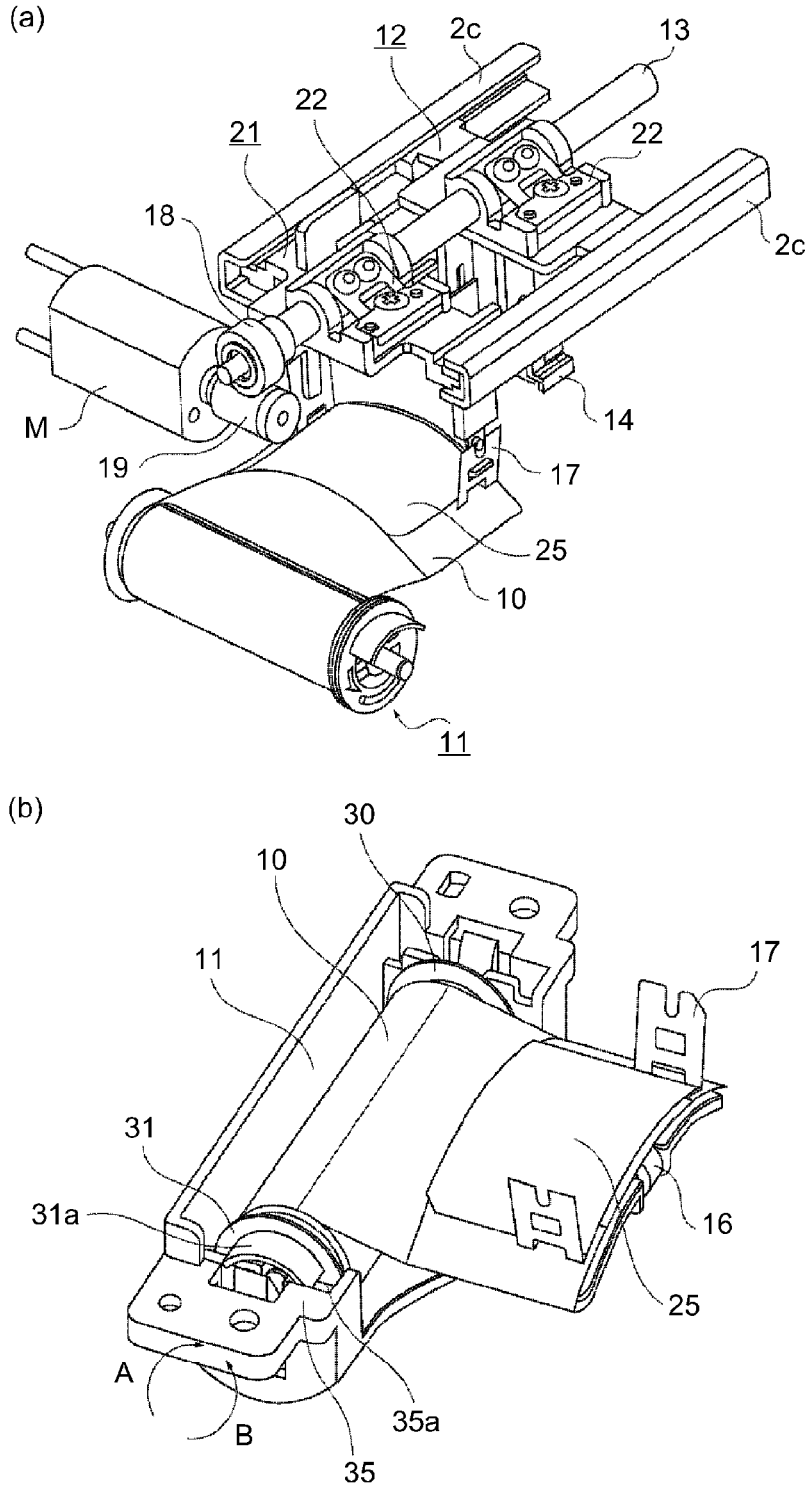
FIG. 2 is a perspective view of the mechanism for opening or closing the corona charger shutter, in the first preferred embodiment.
Figure 3:
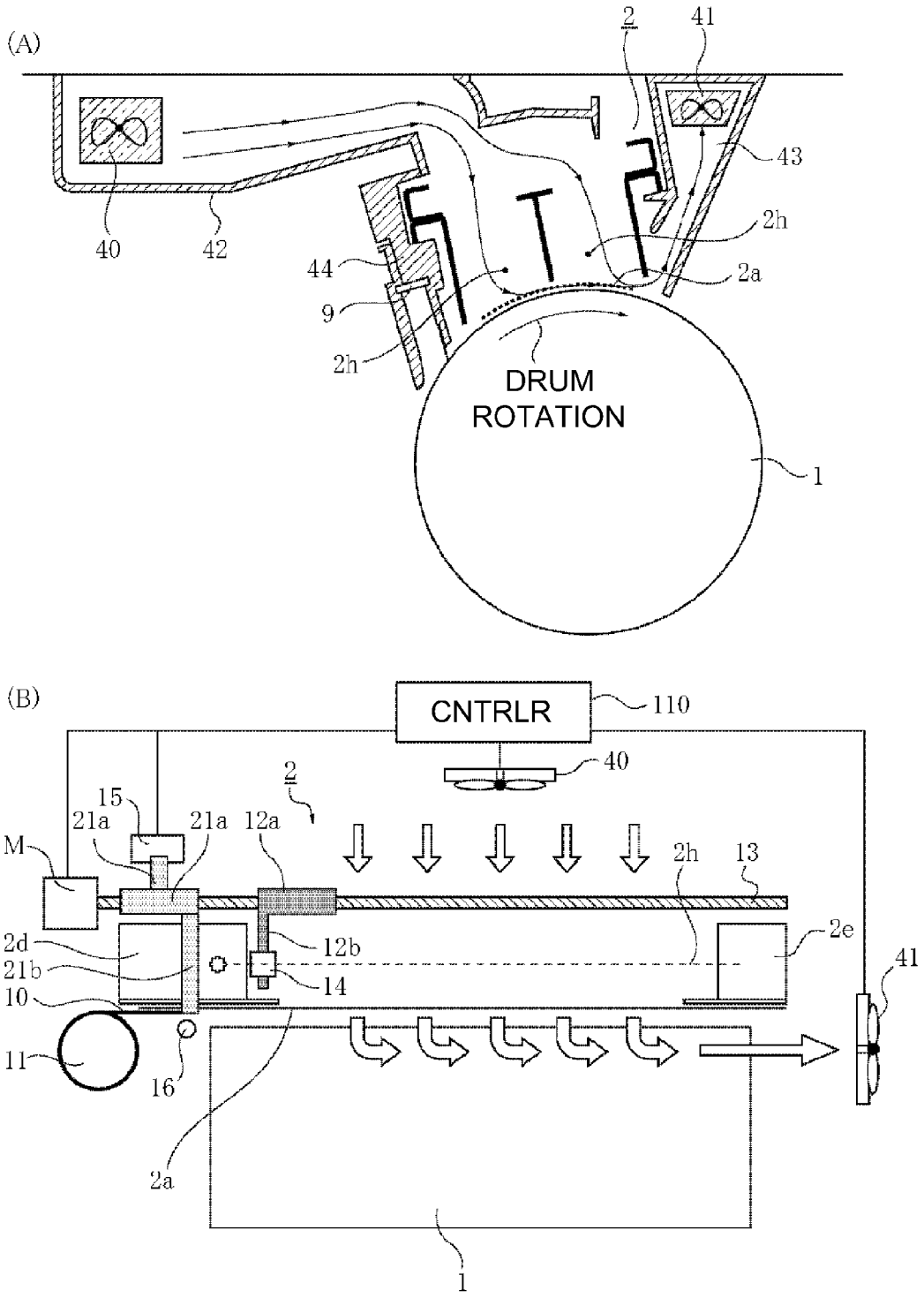
FIG. 3 is a drawing for describing the airflow in the charging device in the first preferred embodiment when the corona charger shutter is open.
Figure 4:
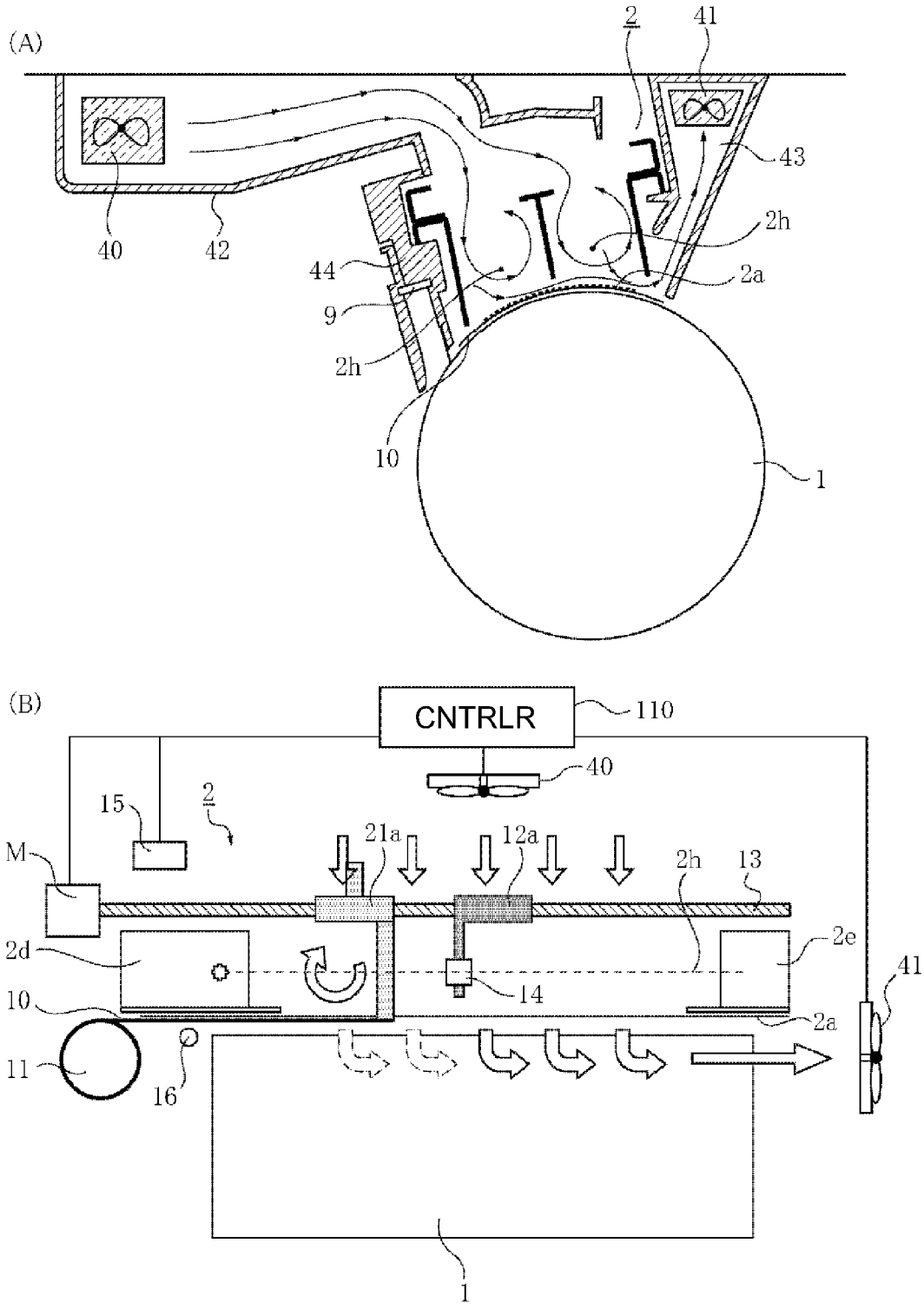
FIG. 4 is a drawing for describing the airflow in the charging device in the first preferred embodiment when the corona charger shutter is closed.

Next, referring to FIGS. 2, 3, and 4, the structure of the charging apparatus of the corona type in this embodiment is described in detail.

(Corona Charger Shutter)

Referring to FIG. 2(*b*), in this embodiment, the corona charger shutter for keeping the opening of the corona charger 2 exposed or blocked is a roll of sheet, which can be rolled up by a shutter winding apparatus 11, for the following reasons. Obviously, one of the reasons is to prevent the problem that the byproducts of corona discharge fall toward the photosensitive member 1 from the corona charger 2 through the opening of the charger 2. As for another reason, the corona charger shutter 10 has to be moved through the narrow gap between the photosensitive member 1 and grid electrode 2*a*. Thus, the shutter 10 has to be such that even if it comes into contact with the photosensitive member 1, the photosensitive member 1 is not damaged seriously enough to cause the image forming apparatus to output low quality images. More specifically, the corona charger shutter 10 in this embodiment is a sheet of unwoven cloth, which is made of rayon fibers and 150 μm in thickness. The reason why the corona charger 2 is structured so that during an image forming operation, the shutter 10 is kept rolled up at one of the lengthwise ends of the corona charger 2 is for minimizing the space necessary to allow the shutter 10 to be opened (retracted) or closed (extended). Incidentally, the unwoven cloth made of rayon fiber, which is used as the material for the corona charger shutter 10, absorbs byproducts of electrical discharge. In addition, the dimension of the shutter 10 in terms of the widthwise direction of the shutter 10 is made to be large enough for the shutter 10 to fully cover the opening 46 (exhaust opening) of the corona charger. Thus, the shutter 10 is capable of absorbing the byproducts of electrical discharge, which are on the wall of the opening 46 (exhaust opening) and the wall of the exhaust duct 43, when the shutter 10 is in its closed position.

Next, referring to FIG. 2(*b*), the corona charger 2 has a leaf spring 17 as a member for keeping the shutter 10 slightly bowed toward the main assembly of the charger 2. The leaf spring 17 is at the downstream end in terms of the direction in which the shutter 10 is closed. Thus, in terms of the widthwise direction of the shutter 10, the center portion of the shutter 10 is kept closer to the main assembly of the corona charger 2 than the end portions of the shutter 10. Further, the corona charger 2 is provided with a roller 16 as a member for controlling the shutter 10 in shape. The roller 16 is next to the shutter winding apparatus 11. In order to minimize the amount by which the photosensitive member 1 is deteriorated by the contact between the shutter 10 and photosensitive member 1, the shutter 10 is made of soft material, as described above, being therefore likely to droop toward the main assembly of the charger 2. This is why the shutter 10 is kept shaped so that it bows toward the charging device. Therefore, the shutter 10 in this embodiment is prevented from sagging toward the main assembly of the corona charger 2 across its center portion in terms of its lengthwise direction.

Using a sheet of soft substance as the material for the corona charger shutter 10 creates a problem in addition to the above described problem that as the fan for exhausting the internal air of the charging device to expel the byproducts of electrical discharge, which are floating in the internal air, the byproducts adheres to the wires for electrical discharge (which hereafter will be referred to as charging wires), causing thereby the corona charger 2 to improperly charge the photosensitive member 1. More specifically, as the corona charger shutter 10 blocks the airflow which is made by the fan to flow toward the photosensitive member 1 through the opening of the corona charger 2, the shutter 10 is made to deform by the airflow. As it is made to deform, it sometimes rubs against the photosensitive member 1, and/or breaks. Further, as it is made to deform, gaps are created between the widthwise ends of the shutter 10 (which is to block opening of charging device to prevent byproducts of electrical discharge from adhering to photosensitive member 1) and the edges of the opening. Consequently, the byproducts of electric discharge adhere to the photosensitive member 1. Thus, it is desired that the control, which is described later in detail, is carried out in order to solve these problems described above.

(Mechanism for Winding Up Corona Charger Shutter)

The shutter winding apparatus 11 has a cylindrical take-up roller 30 (winding member), to which one of the lengthwise ends of the corona charger shutter 10 is attached, and around which the shutter 10 is wound. The shutter winding apparatus 11 has also a bearing 31 and a spring 33 (pressure applying member). The bearing 31 bears one of the lengthwise ends of the take-up roller 30. The spring 33 is in the hollow of the take-up roller 30, and is in connection to the bearing 31. The shutter winding apparatus 11 is attached to a holder 35 as shown in FIG. 2(*b*) in such a manner that the projection 31*a* of the bearing 31 remains in contact with the rib 35*a* of the holder 35. With the employment of this structural arrangement, the bearing 31 and a shaft 32 are not rotatable, and only the take-up roller 30 is rotatably supported by its shaft.

When assembling the corona charger 2, the bearing 31 is attached so that it remains under such a pressure that works in the direction to rotate the bearing 31 in the direction indicated by an arrow mark A. More specifically, before attaching the bearing 31 to the holder 35, it is rotated several times in the direction indicated by an arrow mark B, with the take-up roller 30 solidly fixed to the bearing 31. Thus, when the corona charger shutter 10 is opened, that is, as the shutter 10 is moved by the shutter motor M in the direction indicated by an arrow mark X, the shutter 10 is continuously taken up by the take-up roller 30 without drooping downward. When the opening of the corona charger 2 is remaining entirely blocked by the shutter 10, the shutter 10 is kept pressured in the direction of the arrow X by the resiliency of the spring 33 which is in the hollow of the take-up roller 30. Therefore, it does not occur that when the opening of the corona charger 2 remains entirely block by the shutter 10, the shutter 10 droops downward. In other words, the corona charger 2 is structured so that when the shutter 10 is in its position in which it keeps the opening of the corona charger 2 blocked, no gap is created between the corona charger shutter 10 and the main assembly of the corona charger 2. Therefore, when the corona charger 2 is not being used for image formation, it can remain in a state in which the byproducts of electrical discharge (corona) are unlikely to leak out of the corona charger 2.

(Mechanism for Driving Corona Charger Shutter and Cleaning Member)

Next, referring to FIG. 2(*a*), the mechanism for opening or closing (moving) the corona charger shutter 10 and moving the cleaning member is described. FIG. 2(*a*) is a detailed perspective view of the mechanism for moving the shutter 10 and cleaning member 14. This mechanism has: a motor M; a shutter winding apparatus 11; a first movable member 21 which holds the shutter 10; a second movable member 12 which holds the cleaning member 14; and a rotatable member 13. Having these components, the mechanism can move (open or close) the corona charger shutter 10 in the lengthwise direction of the shutter 10 (primary scan direction). The mechanism has also a shutter position detecting apparatus 15 which detects the completion of the opening of the shutter 10. The shutter position detecting apparatus 15 is a photo-interrupter. As the first movable member 21 reaches its shutter opening operation completion position, the beam of light which is being projected upon the photo-interrupter 15 is blocked by a light blocking member 21*c*. Thus, as the beam of light being projected upon the photo-interrupter (15) is blocked by the light blocking member 21*c*, the shutter position detecting apparatus 15 determines that the corona charger shutter 10 has just been fully opened (is fully open). That is, the mechanism for moving the shutter 10 and cleaning member 14 is structured so that as soon as the shutter position detecting apparatus 15 detects the light blocking member 21*c* of the first movable member 21, the rotation of the motor M is stopped.

Each of the first and second movable members 21 and 12 has a driving force receiving member 22, which is in engagement with a rotatable member 13, and through which the first and second movable members 21 and 12 receive driving force. The engagement between the driving force receiving member 22 and the rotatable member 13 is such that the first and second movable members 21 and 12 are allowed to move only in the primary scan direction on a pair of rails 2*c* with which the corona charger 2 is provided. Thus, the first and second movable members 21 and 12 are prevented from rotating with the rotatable member 13. The rotatable member 13 has spiral grooves. One of the lengthwise ends of the rotatable member 13 is fitted with a gear 18, whereas one of the lengthwise ends of the shaft of the motor M is fitted with a worm gear 19. Thus, the driving force from the motor M is transmitted to the rotational member 13 through the meshing between the worm gear 19 and gear 18. Therefore, as the rotatable member 13 is rotated by the motor M, the first and second movable members 21 and 12 are moved in the primary scan direction by their own driving force transmitting members 22, one for one, which are guided by the spiral grooves of the rotatable member 13 in the primary scan direction (X, Y directions). That is, the mechanism for moving the corona charger shutter 10 and cleaning member 14 is structured so that as the rotatable member 13 is driven by the motor M, the force for moving the shutter 10 in the opening or closing direction is transmitted to the shutter 10 through the driving force receiving portion 21*b* which is an integral part of the first driving force receiving member 21. Further, the second movable member 12 has a driving force receiving portion 12*b* which holds the cleaning member 14 for cleaning the charging wires 2*h* for discharging electrical charge. The driving force receiving portion 12*b* is an integral part of the second movable member 12.

Therefore, as the corona charger shutter 10 is moved by the motor M in the primary scan direction (X, Y directions) as described above, the cleaning member 14 also is moved in the same direction at the same time. In other words, the employment of the above described structural arrangement makes it possible to move the cleaning member 14 for cleaning the charging wires 2*h*, and the corona charger shutter 10 with the same motor M. Thus, as the shutter 10 is moved to unblock or block the opening of the corona charger 2, the cleaning member also is moved as shown in FIGS. 3(B) and 4(B). Similarly, as the cleaning member 14 for cleaning the charging wire is moved, the corona charger shutter 10 also is moved.

(Ventilation Mechanism for Removing Byproducts of Electrical Discharge)

The corona charger 2 in this embodiment has an exhaust fan for expelling the air-borne byproducts of electrical discharge in the charger 2. More concretely, the corona charger 2 is provided with a fan 40 (intake fan) for blowing air toward the photosensitive member 1 from the top portion of the charger 2. The corona charger 2 has also an exhaust fan 41 for exhausting the air which is between the opening of the corona charger 2 and the photosensitive member 1. The exhaust fan 41 is on the downstream side of the intake fan 40 in terms of the rotational direction of the photosensitive member 1, and is in the adjacencies (roughly 2-5 mm) of the corona charger 2. Incidentally, the body of air, which contains the byproducts of electrical discharge is discharged from the image forming apparatus after it is put through an unshown filter. Both the intake fan 40 and exhaust fan 41 are of the axial flow type. They are adjusted in revolution to make the air speed in the adjacencies of the opening of the corona charger 2 roughly 0.5 m/s. The intake fan 40 is at the upstream end of an intake air duct 42 in terms of the airflow direction. The shield 2*b* of the corona charger 2 is at the opposite end of the corona charger 2 from the photosensitive member 1 in terms of the direction perpendicular to the peripheral surface of the photosensitive member 1, and is roughly the same in dimension as the charging range of the corona charger 2 in terms of the widthwise direction of the corona charger 2. The combination of the air intake fan 40 and duct 42 are structured so that the airflow becomes uniform across the two air intake holes 45. The corona charger 2 has two chambers separated by the shield 2*b* positioned in a manner to block between the two charging wires 2*h*. The shield 2*b* is structured so that its center and downstream portions in terms of the rotational direction of the photosensitive member 1 is greater in the gap from the peripheral surface of the photosensitive member 1 than its downstream portion. Therefore, as air is blown into each of the abovementioned two chambers through the air intake holes 45, it flows downstream, in terms of the rotational direction of the photosensitive member 1, along the peripheral surface of the photosensitive member 1. Further, the gap between the downstream portion of the shield 2*b* and the peripheral surface of the photosensitive member 1, which is the largest among the abovementioned gaps, serves as an air exhaust opening 46, through which the air blown into the corona charger 2 is exhausted.

There is an exhaust duct 43 in the adjacencies of the downstream side of the exhaust opening 46 exhaust opening 46. The internal air of the corona charger 2 is suctioned out of the corona charger 2 by the exhaust fan 41 through the entirety of the exhaust opening 46, and sent into the rear portion of the main assembly of the image forming apparatus by the exhaust fan 41.

(State of Shutter, and Airflow)

Next, referring to FIGS. 3(A) and 4(A), the airflow which occurs when the opening of the corona charger 2 is unblocked, and the airflow which occurs when the opening of the corona charger 2 is blocked, will be described.

In order to prevent the problem that the toner particles on the peripheral surface of the photosensitive member 1 pass by the cleaning blade 8 and adhere to the charging wires 2*h* of the corona charger 2, these fans 40 and 41 cause air to flow from the opening of the corona charger 2 toward the photosensitive member 1. With the creation of this airflow, the internal air of the corona charger 2, which contains a large amount of byproducts of electrical discharge, is exhausted out of the corona charger 2. Therefore, the problem that the photosensitive member 1 becomes improperly charged by the abnormal discharge of electrical charge, which is attributable to the adhesion of the toner particles having adhered to the photosensitive member 1 and passed by the cleaning blade 8, is prevented.

FIG. 3(A) shows the airflow which occurs in the corona charger 2 when the opening of the corona charger 2 is not blocked. When the opening is not blocked by the shutter 10, the airflow can expel, without being disturbed, the byproducts of electrical discharge, which are lingering in the corona charger 2.

FIG. 4(A) shows the airflow which occurs in the corona charger 2 when at least a part of the opening of the corona charger 2 remains blocked by the corona charger shutter 10. When at least a part of the opening of the corona charger 2 remains blocked by the corona charger shutter 10 as shown in FIG. 4(A), the airflow changes in such a manner that it allows the byproducts of electrical discharge, which are lingering in the corona charger 2, to adhere to the charging wires 2*h*. Thus, turning on the fans 40 and 41 to expel the byproducts of electrical discharge in the corona charger 2 out of the charger 2 while cleaning the charging wires causes the byproducts to adhere to the charging wires 2*h*, resulting thereby in the improper charging of the photosensitive member 1.

That is, if the corona charger shutter 10 is opened or closed while the intake fan 40 and exhaust fan 41 are on, the corona charger shutter 10 blocks the airflow, and therefore, the internal air of the corona charger 2 is disturbed, As a result, the byproducts of electrical discharge, which are on the shield 2*b* of the corona charger 2 are scattered by the turbulence (disturbed airflow), and adhere to the grid electrode 2*a* and/or charging wires 2*h*, which causes the image forming apparatus to output images which suffer from the nonuniformity attributable to the abnormal electrical discharge. Further, in a case where a corona charger shutter (10) is made of thin unwoven fabric like the corona charger shutter 10 in this embodiment, the shutter is made to flutter by the airflow (in particular, when fan speed is high) when the shutter is open or closed. As the shutter flutters, it sometimes comes into contact with the peripheral surface of the photosensitive member 1, contaminating thereby the peripheral surface of the photosensitive member 1. Further, as the shutter flutters, it sometimes partially bent away from the edge portion of the opening of the corona charger 2, creating gaps, between itself and the edge portion, through which the byproducts of electrical discharge flow out of the corona charger 2.

(Control of Movement of Corona Charger Shutter and Movement of Cleaning Member)

Figure 5:
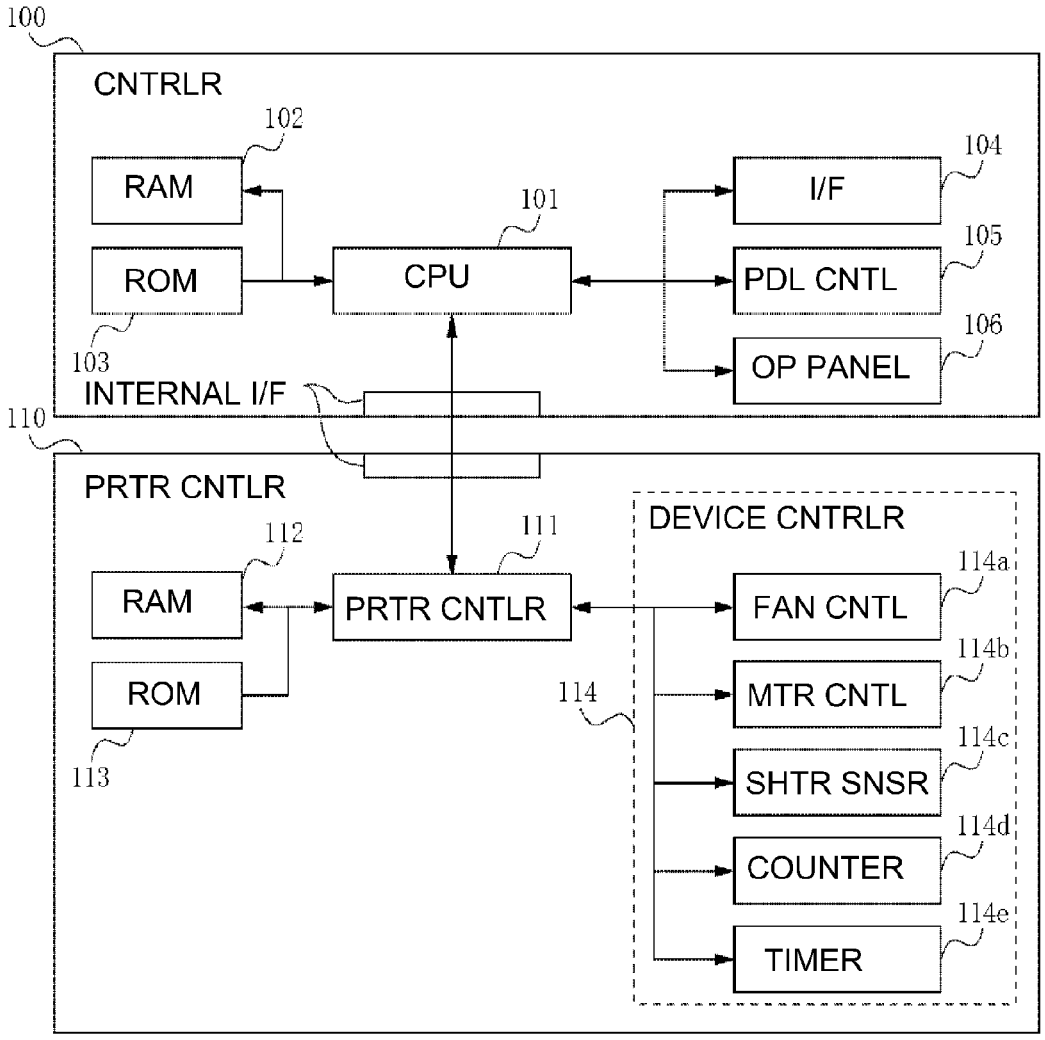
FIG. 5 is a block diagram of the control circuit which controls the image forming apparatus in the first preferred embodiment.
Figure 6:
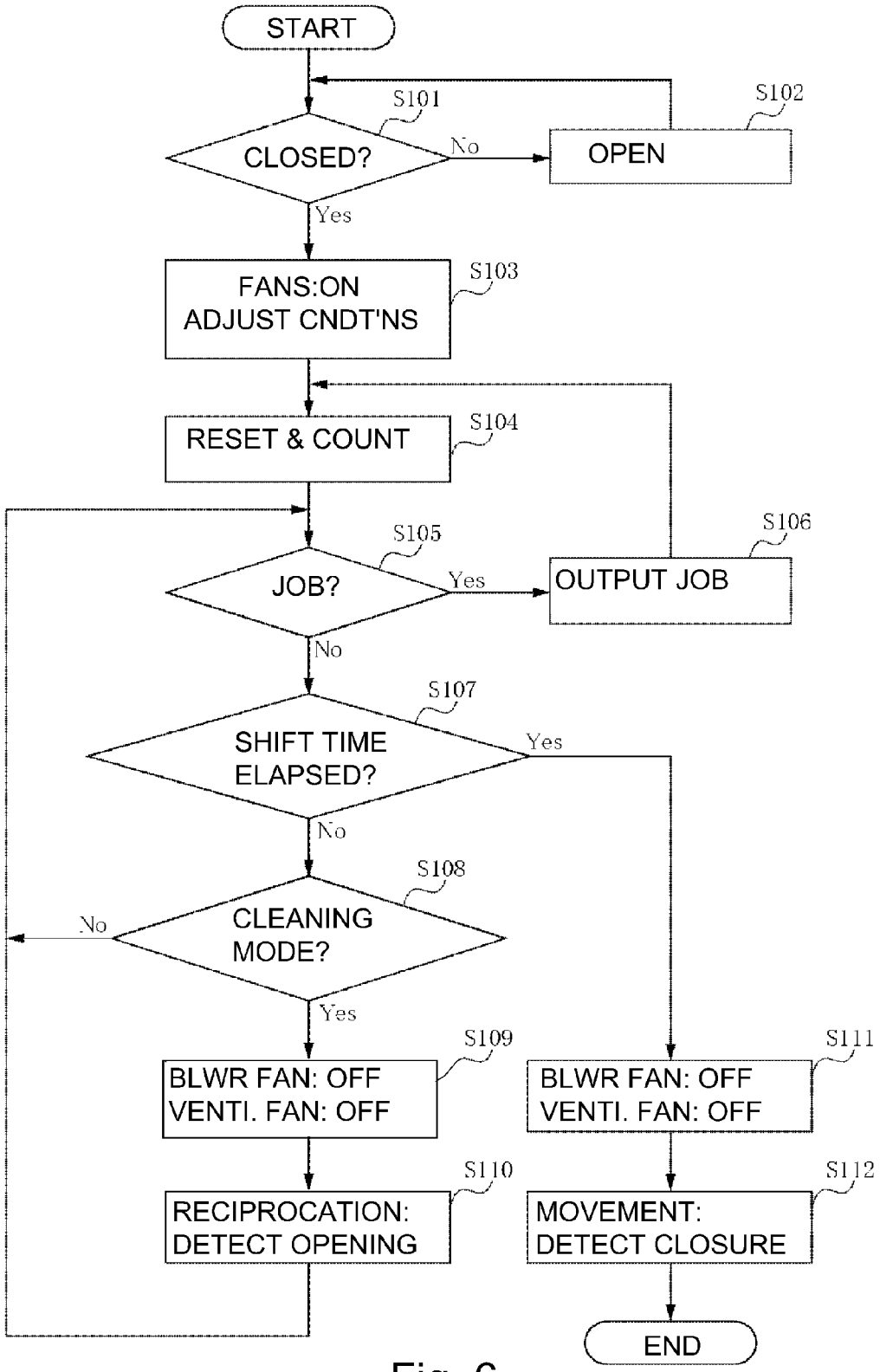
FIG. 6 is a block diagram of the control sequence for moving the corona charger shutter and cleaning member.

As described above, keeping the intake fan 40 turned on while the opening of the corona charger 2 remains blocked with the corona charger shutter 10 causes the byproducts of electrical discharge to be hauled up by the air turbulence, and adhere to the charging wires 2*h*, which in turns causes the photosensitive member 1 to be improperly charged. In this embodiment, therefore, the corona charger 2 is controlled so that when the corona charger shutter 10 is opened or closed, the fans are kept turned off. Next, referring to FIGS. 5 and 6, how the corona charger 2 is controlled when the corona charger shutter 10 is opened or closed is described. FIG. 5 is a block diagram of the control circuit (hardware) for controlling the image forming apparatus. FIG. 6 is a flowchart of the control for opening or closing the corona charger shutter 10.

(Block Diagram of Control Circuit)

FIG. 5 is a block diagram of the hardware, more specifically, the CPU (Central Processing Unit), as the means for controlling the image forming apparatus 1. It is for describing the connection among various portions of the apparatus. The image forming apparatus 1 is controlled by a controller 100 and a controller 110. The controller 100 controls a job, whereas the controller 110 controls the printer portion of the apparatus, which turns image formation data into a visible image on a sheet of recording medium.

Controller 100:

The controller 100 has: a CPU 101; a ROM 103 (Read Only Memory) which holds control programs; a RAM 102 (Random Access Memory) which stores the data to be processed. These components are in connection to each other through buses, being enabled to exchange information with each other (communicate).

The CPU 101 has: an I/O interface 104 for communicating with external components; and a PDL control 105 which processes and stores received data, and carries out image processing. The CPU 101 is in connection to the printer controller 110 through an I/O interface.

Printer Controller 110:

The printer controller 110 primarily controls an image forming operation by controlling the printing portion (each image forming portion) of the image forming apparatus. The printer controller 110 has: a controller 111; a ROM 113 which holds control programs; a RAM 112 which stores data for image formation. These components are in contact with each other through buses, being enabled to communicate with each other. The ROM 113 stores the programs for carrying out the control sequence in FIGS. 5 and 6. A device controller 114 is an electrical circuit which has an input/output port, or the like, for controlling the various structural components of the printing portion.

The device controller 114 has: a fan controlling portion 114*a* which controls the intake fan 40 and exhaust fan 41 (operation for suctioning ambient air into corona charger 2, and operation for exhausting internal air of corona charger 2); a motor controlling portion 114*b* which controls the motor for moving the shield (corona charger shutter) for shielding the photosensitive member 1. The device controller 114 has also a shutter sensor 114*c* which detects the position of the corona charger shutter 10 as a shield. Further, the device controller 114 has: a counter 114*d* which counts the number of the images formed by the image forming apparatus 1; and a timer 114*e* which measures the length of the time which elapsed since the completion of an image formation operation (for example, when rotation of photosensitive member 1 was stopped).

(Description of Corona Charger Control)

Next, the control for opening or closing the corona charger shutter 10 is described with reference to FIG. 6, which is a flowchart of the control sequence for opening or closing the corona charger shutter 10, and for activating or deactivating the cleaning member 14. The CPU 101 as a controlling means controls each of the various portions of the image forming apparatus 1, as follows, according to the programs stored in the ROM 103.

The control sequence is described in correspondence with the above described operational modes. The steps S101-S103 are related to the control in the start-up period, that is, the period from when the electric power source is turned on to when the image forming apparatus is put in the standby mode. The steps S104-S108 are related to the control in the standby mode, in which the image forming apparatus 1 is kept ready for image formation. They form a loop. The steps S109 and S110 are related to the cleaning modes in which the charging wires 2*h* are cleaned. The steps S111 and S112 are related to the low electric power consumption mode, that is, the mode in which the opening of the corona charger 2 is kept clocked by the corona charger shutter 10 to prevent the image forming apparatus 1 from outputting images, some areas of which are missing ("image deletion"). Hereafter, each of the abovementioned steps is described in detail.

The step S101 is carried out when the electric power source of the image forming apparatus 1 is turned on. In this step, the position of the corona charger shutter 10 is detected. More specifically, in this step, the CPU 101 as a controlling means determines whether or not the opening of the corona charger 2 is remaining blocked by the corona charger shutter 10, based on the signals which it receives from the shutter sensor 114*c*. If it determines that the corona charger shutter 10 is not open, it controls the motor controller 114*b* so that the screw is rotated in the direction to open the corona charger shutter 10 (S102). As soon as the corona charger shutter 10 becomes completely open, it controls the fan controller so that the intake fan 40 and exhaust fan 41 begin to rotate, and then, begins to set (adjust) the image formation conditions for a job (S103). Then, it resets the timer 114*e*, and makes the timer 114*e* start measuring the length of time which has elapsed since the resetting of the timer 114*e* (S104).

After the completion of the startup process, the CPU 101 waits for the inputting of image formation signals (signals for printing job), or puts the image forming apparatus in the standby mode (No in all of S105, S107, and S108) until it puts the apparatus in the low electric power consumption mode after the elapse of a certain length of time in the standby mode. As soon as image formation signals are inputted into the image forming apparatus in the standby mode (Yes in S105), the CPU 101 controls the printer controller 110 so that an image forming operation is carried out based on the inputted image formation signals (S106). After the completion of the image forming operation, the CPU 101 resets the timer 114*e* (S104).

If the electric power source is automatically turned off after the elapse of a preset length time since the completion of the image forming operation, or is turned off by a user (Yes in S107), the CPU 101 carries out the step S111 (puts image forming apparatus in low electric power consumption mode).

The steps S111 and S112 are for preventing the problem that when the corona charger shutter 10 is closed to put the image forming apparatus in the low electric power consumption mode, the photosensitive member 1 is improperly charged, and is damaged by the corona charger shutter 10. The CPU 101 stops driving the intake fan 40 and exhaust fan 41 (S111), and blocks the opening of the corona charger 2 by driving the motor M so that the rotatable member 13 (screw) is rotated in the opposite direction from the direction in which the rotatable member 13 is rotated to open the corona charger shutter 10 (S112).

Each time the CPU 101 detects through the image formation counter that a preset number of images have been formed, it carries out the step S109 (wire cleaning mode).

Also while the charging wires 2*h* are cleaned, the CPU 101 keeps the intake fan 40 and exhaust fan 41 turned off to prevent the photosensitive member 1 from being improperly charged, and also, the corona charger shutter 10 from damaging the photosensitive member 1. More specifically, the CPU 101 as a controlling means stops the intake fan 40 and exhaust fan 41 (S109). Then, it stops the motor M after rotating the motor M for a preset length of time (S109). Next, it moves the first and second movable members 21 and 12 to their open positions by rotating the motor M in the opposite direction from the direction in which it rotates the motor M when it closes the corona charger shutter 10 (S110).

As described above, the image forming apparatus (corona charger) in this embodiment can prevent that problem that the photosensitive member 1 is improperly charged because the byproducts of electrical discharge adhere to the charging wires 2*h* when cleaning the charging wires 2*h* to prevent the photosensitive member 1 from being improperly charged, and also, when closing the corona charger shutter 10 to prevent the formation of images, some portions of which are missing ("image deletion").

Embodiment 2

Next, the second preferred embodiment of the present invention is described. The structural components of the image forming apparatus (corona charger) in this embodiment, which are the same in structure as the counterparts in the first embodiment are given the same referential codes as those given to the counterparts in the first embodiment, and are not going to be described here. In the first preferred embodiment, in order to prevent the byproducts of the electric discharge from adhering to the charging wires 2*h*, the intake fan 40 and exhaust fan 41 are kept turned off. However, the primary cause of the adhesion of the byproducts of electric discharge to the charging wires 2*h* is the turbulence that occurs as the airflow from the opening of the corona charger 2 toward the photosensitive member 1 is blocked by the corona charger shutter 10. In this embodiment, therefore, the intake fan 40 and exhaust fan 41 are modified in operation to prevent the airflow in the shield 2*b* of the corona charger 2 from being disturbed by the closing of the corona charger shutter 10, as is evident from FIG. 4(A).

(Fan Operation when Shutter is Closed, and Airflow)

Figure 7:
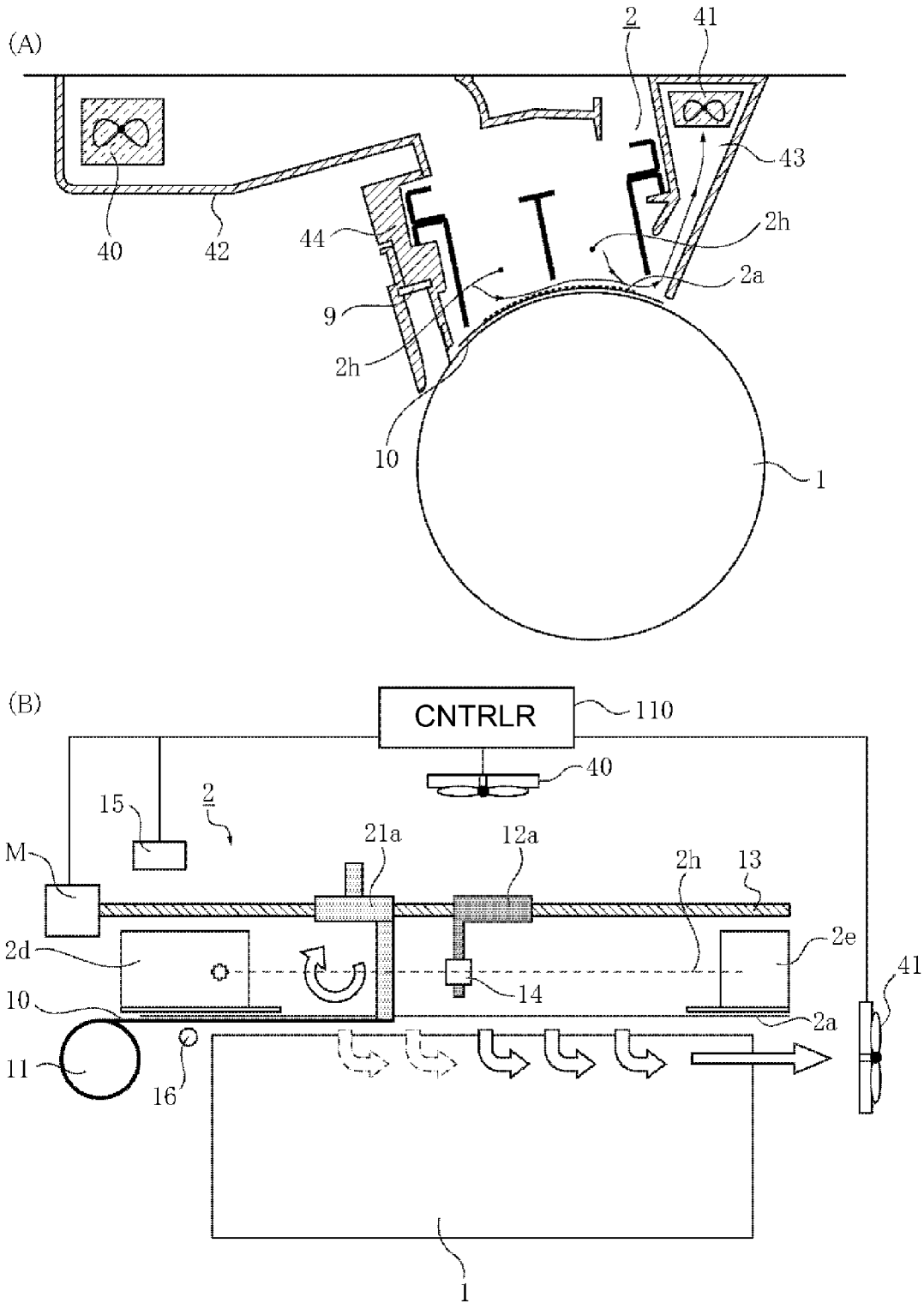
FIG. 7 is a drawing for describing the airflow in the charging device, in the second preferred embodiment of the present invention, when the corona charger shutter is open.
Figure 8:
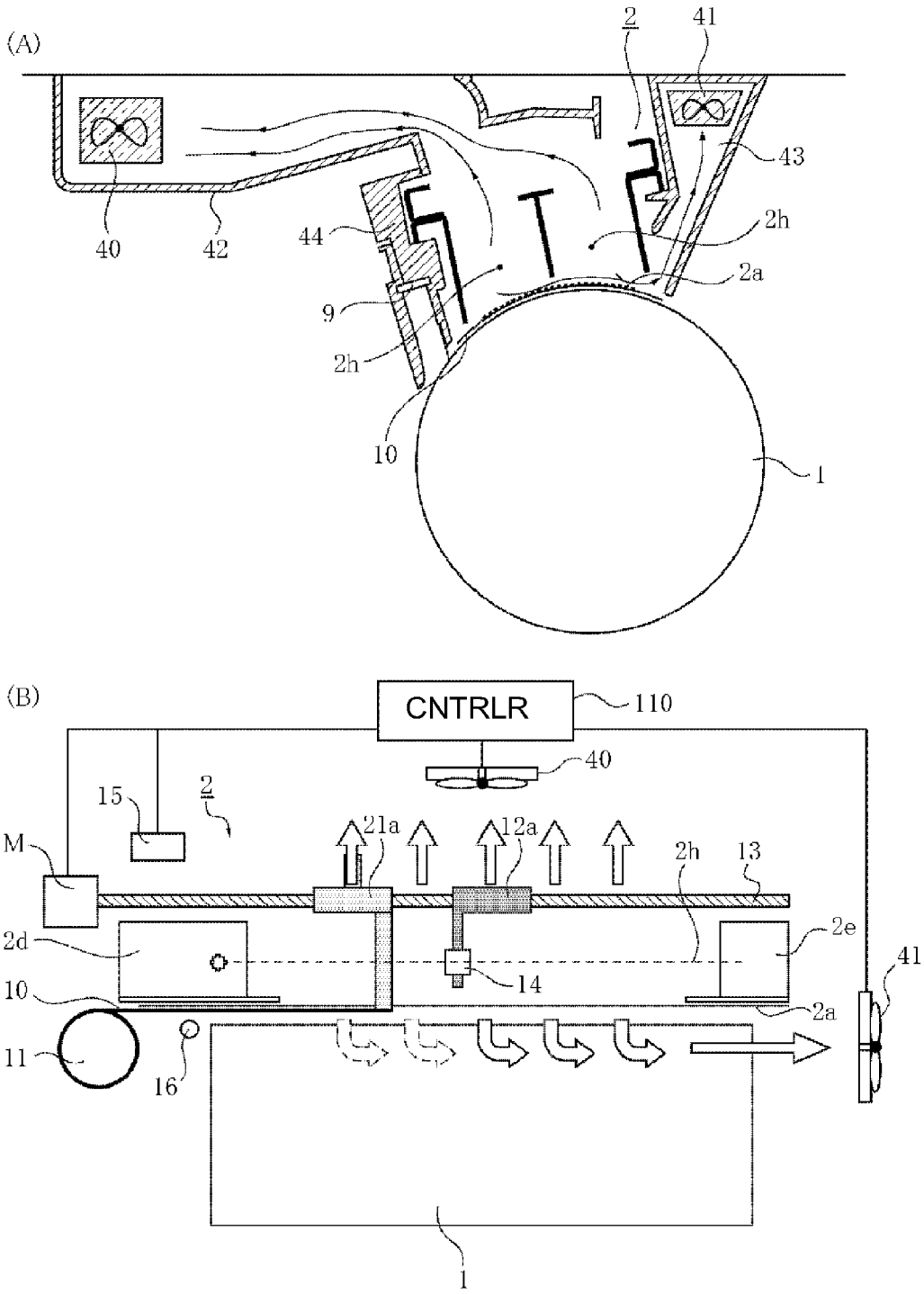
FIG. 8 is a drawing for describing the airflow in the charging device, in the second preferred embodiment, when the corona charger shutter is closed.

Next, referring to FIGS. 7 and 8, the case in which the intake fan 40 is kept turned off, but, the internal air of the corona charger 2 is continuously exhausted with the use of only the exhaust fan 41, and the case in which the internal air of the corona charger 2 is continuously exhausted by the intake fan 40, which is rotated in reverse, and the exhaust fan 41, are described.

FIG. 7 is a drawing for describing where in the corona charger 2 air flows if only the intake fan 40 is stopped, and the exhaustion of the internal air of the corona charger 2 is continued by the exhaust fan 41. The stopping of the intake fan 40 prevents the problem that the byproducts of electrical discharge in the corona charger 2 are picked up by the air turbulence in the inward adjacencies of the opening of the corona charger shutter 10, and also, the problem that the byproducts of electrical discharge adhere to the photosensitive member 1 by being dispersed from the adjacencies of the opening of the corona charger 2 toward the photosensitive member 1.

FIG. 8 is a drawing for describing where in the corona charger 2, air flows when the exhaustion of the internal air of the corona charger 2 is continued by the exhaust fan 40 while exhausting the internal air by rotating the intake fan 40 in reverse. In this case, the air in the adjacencies of the photosensitive member 1 is suctioned toward the opening of the corona charger 2. Therefore, the corona charger shutter 10 is pressured toward the grid electrode 2*a* by the airflow. Further, the internal air of the corona charger 2 is suctioned from the opening side of the corona charger 2 toward the charging wires (upward in FIG. 8), as is evident from FIG. 8. Therefore, the internal air does not swirl in such a manner that the charging wires 2*h* are contaminated by the byproducts of electrical discharge in the internal air. Therefore, the problem that the photosensitive member 1 is improperly charged because of the adhesion of the byproducts of electrical discharge to the charging wires 2*h* does not occur. Incidentally, using material such as unwoven fabric which is more or less permeable by air as the material for the corona charger shutter 10 can minimize the problem that the corona charger shutter 10 rubs against the grid electrode while the internal air of the corona charger 2 is exhausted (suctioned out) by the intake fan 40. Further, the intake fan 40 and exhaust fan 41 are adjusted in revolution so that the air speed between the opening of the corona charger 2 and photosensitive member 1 becomes roughly 0.1 m/s. This adjustment can prevent the problem that the corona charger shutter 10 is frictionally worn by rubbing hard against the grid electrode 2*a*. Further, in this embodiment, the internal air of the corona charger 2 is exhausted by rotating the intake fan 40 in reverse, in addition to exhausting the internal air by the exhaust fan 41. However, instead of rotating the intake fan 40 in reverse, the corona charger 2 may be provided with another exhaust fan (41) beside the exhaust fan 41. Providing the corona charger 2 with another exhaust fan (41) reduces the possibility that the photosensitive member 1 is scarred by the friction between the photosensitive member 1 and corona charger shutter 10. Further, it can prevent the problem that when the corona charger shutter 10 is opened or closed, the byproducts of electrical discharge adhere to the photosensitive member 1 by being dispersed from the adjacencies of the opening of the corona charger 2 toward the photosensitive member 1 before the opening is completely blocked.

(Description of Control of Corona Charger with Reference to Flowcharts)

Figure 9:
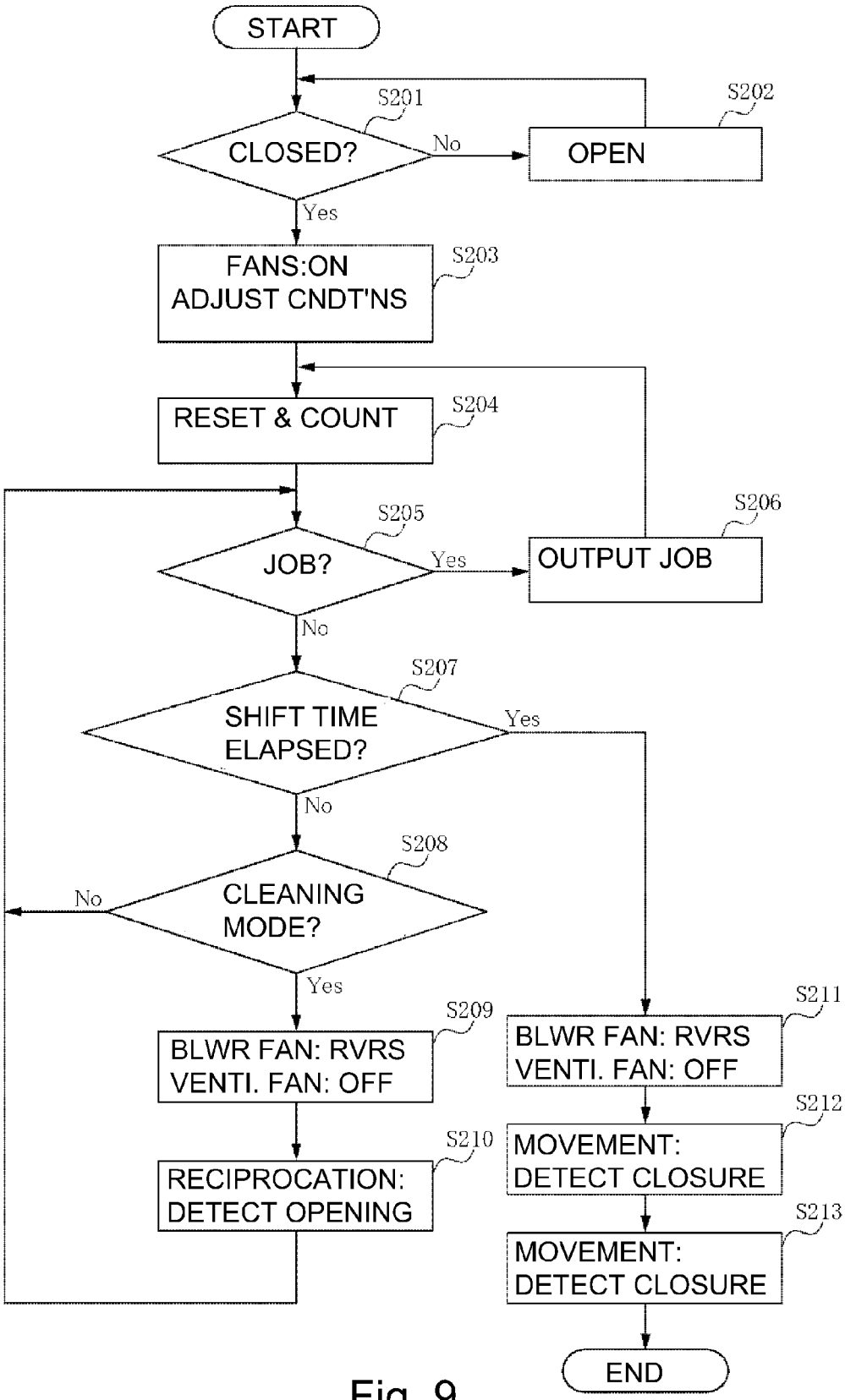
FIG. 9 is a flowchart of the control sequence for moving the corona charger shutter and cleaning member.

Next, the control of the corona charger 2 in this embodiment is described with reference to FIG. 9 (flowchart). The steps in the flowchart except for steps S209, S211, and S213 are the same in the processes carried out therein as those in the first embodiment. Therefore, they are given the similar referential codes to those in the first embodiment, and are not described. FIG. 9 is related to the control sequence carried out to control the corona charger 2 when the corona charger shutter 10 is opened or closed and the charging wires 2*h* are cleaned. The CPU 101 as a controlling means controls each of the various portions of the image forming apparatus following the programs stored in the ROM 103.

Steps S209-S210 are for controlling the corona charger 2 when cleaning the charging wires. In these steps, the improper charging of the photosensitive member 1, the deterioration of the photosensitive member 1 by the rubbing of the photosensitive member 1 by the corona charger shutter 10, and the adhesion of the byproducts of electrical discharge to the photosensitive member 1, are prevented by continuing to exhausting the internal air of the corona charger 2 by the exhaust fan 41 and rotating the intake fan 40 in reverse. More specifically, the CPU 101 as a controlling means suctions out the internal air of the corona charger 2 by rotating the intake fan 40 in reverse, and also, rotates the exhaust fan 41 (S209). Then, it stops the motor M after rotating the motor M for a preset length of time. Then, it moves the first and second movable members 21 and 12 to their closed positions by rotating the motor M in the opposite direction from the direction in which it rotates the motor M when opening the corona charger shutter 10 (S210).

Steps S211 to S213 are transitional steps to the low electric power consumption mode. These steps are for preventing the problem that when the corona charger shutter 10 is closed, the photosensitive member 1 is improperly charged, and the corona charger shutter 10 damages the photosensitive member 1. More specifically, the CPU 101 as a controlling means suctions out the internal air of the corona charger 2 by rotating the intake fan 40 in reverse, and rotates the exhaust fan 41 in the normal direction (S211). Further, it blocks the opening of the corona charger 2 by closing the corona charger shutter 10 by driving the motor M to rotate the rotatable member 13 (screw) in the opposite direction from the direction in which the rotatable member 13 is rotated to open the corona charger shutter 10 (S212). Then, it stops the rotation of the intake fan 40 and exhaust fan 41 as soon as the corona charger shutter 10 blocks the opening of the corona charger 2 across the entire range of the opening (S213).

Incidentally, in the embodiments of the present invention described above, the corona charger 2 was used to virtually uniformly charge the peripheral surface of the photosensitive member 1 immediately prior to the formation of an electrostatic latent image on the peripheral surface of the photosensitive member 1. However, the application of the present invention is not limited to such a case as that in the preceding embodiments. That is, the present invention is applicable to a case in which a corona charger is used to charge a toner image on the photosensitive member 1.

Also in the embodiments of the present invention described above, the corona charger had a grid electrode 2*a*, which was at the opening of the charging device. However, the present invention is also applicable to a corona charger, which does not have a grid electrode.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 052020/2010 filed Mar. 9, 2010 which is hereby incorporated by reference.

What is claimed is:

1. An image forming apparatus comprising:

a rotatable photosensitive member;

a corona charger, including a charging electrode, configured to charge said photosensitive member;

a cleaning member configured to clean said charging electrode;

a shield surrounding said charging electrode and having an opening between said charging electrode and said photosensitive member;

a shutter in the form of a sheet configured to open and close the opening;

driving means configured to drive said shutter and said cleaning member interrelatedly;

a toner image forming portion configured to form a toner image on said photosensitive member charged by said corona charger;

a fan configured to supply air toward said photosensitive member through the opening; and control means configured to control said fan such that an air supply operation of said fan is stopped before said shutter operates to close the opening, and said shutter closes the opening in a state of nonoperation of the air supply of said fan.

2. An apparatus according to claim 1, further comprising a duct provided adjacent to the opening of said corona charger at a position downstream of said corona charger and upstream of said toner image forming portion with respect to a rotational moving direction of said photosensitive member, and an exhaust fan configured to discharge the air to an outside of said apparatus through said duct, wherein said control means controls said exhaust fan to continue the discharging operation when the opening is closed by said shutter.

3. An apparatus according to claim 1, further comprising a regulating member for regulating a configuration of said shutter such that a widthwisely central portion of said shutter is projected toward said charging electrode more than widthwisely end portions of said shutter.

4. An apparatus according to claim 1, wherein said shutter comprises nonwoven fabric.

5. An image forming apparatus comprising:

a corona charger, including a charging electrode, for charging a photosensitive member;

a cleaning member for cleaning said charging electrode;

a shutter in the form of a sheet for opening and closing an opening provided between said charging electrode of said corona charger and the photosensitive member;

driving means for driving said shutter and said cleaning member;

a fan provided at a position across said charging electrode of said corona charger from the opening; and control means for controlling said fan such that the air flows toward the photosensitive member through the opening in a period in which said shutter does not close the opening and that the air flows toward the opening from the photosensitive member during a closing operation of said shutter.

6. An apparatus according to claim 1, wherein said control means causes said shutter to open the opening in a state of nonoperation of the air supply of said fan, and causes said fan to start the air supply operation after said shutter opens the opening.

7. An image forming apparatus comprising:

a rotatable photosensitive member;

a corona charger, including a charging electrode, configured to charge said photosensitive member;

a shield surrounding said charging electrode and having an opening between said charging electrode and said photosensitive member;

a shutter in the form of a sheet configured to open and close the opening;

driving means configured to drive said shutter;

a toner image forming portion configured to form a toner image on said photosensitive member charged by said corona charger;

a fan configured to supply air toward said photosensitive member through the opening; and control means configured to control said fan such that an air supply operation of said fan is stopped before said shutter operates to close the opening, and said shutter closes the opening in the state of nonoperation of air supply of said fan.

8. An apparatus according to claim 7, wherein said control means prevents the air supply operation of said fan while said shutter closes the opening.

9. An apparatus according to claim 7, wherein said control means causes said shutter to open the opening in the state of nonoperation of the air supply of said fan, and causes said fan to start the air supply operation after said shutter opens the opening.

10. An apparatus according to claim 1, wherein said fan maintains the air supply operation when said corona charger charges said photosensitive member to form the toner image.

11. An apparatus according to claim 10, wherein the air supply operation of said fan stops after a charging operation of said corona charger on said photosensitive member to form the toner image is completed.

12. An apparatus according to claim 11, wherein the air supply operation of said fan stops when a predetermined time period elapses after formation of the toner image.

13. An apparatus according to claim 1, wherein the air supply operation stops after a stop of rotation of said photosensitive member.

* * * * *